US008214936B2

(12) United States Patent
Thweatt, Jr.

(10) Patent No.: US 8,214,936 B2
(45) Date of Patent: Jul. 10, 2012

(54) SPA HAVING HEAT PUMP SYSTEM

(75) Inventor: Carlisle Thweatt, Jr., South Haven, MI (US)

(73) Assignee: Caldesso, LLC, San Bernardino, CA (US)

( * ) Notice: Subject to any disclaimer, the term of this patent is extended or adjusted under 35 U.S.C. 154(b) by 0 days.

(21) Appl. No.: 12/571,780

(22) Filed: Oct. 1, 2009

(65) Prior Publication Data

US 2010/0017952 A1 Jan. 28, 2010

Related U.S. Application Data

(63) Continuation of application No. PCT/US2008/059225, filed on Apr. 3, 2008.

(60) Provisional application No. 60/909,869, filed on Apr. 3, 2007.

(51) Int. Cl.
*E04H 4/00* (2006.01)

(52) U.S. Cl. ..... 4/493; 4/541.1; 62/238.6

(58) Field of Classification Search ..... 4/493, 541.1, 4/541.3, 545; 62/160, 238.6, 238.7
See application file for complete search history.

(56) References Cited

U.S. PATENT DOCUMENTS

| | | | |
|---|---|---|---|
| 2,775,683 | A | 12/1956 | Kleist |
| 3,088,017 | A | 4/1963 | Schomann |
| 3,781,925 | A | 1/1974 | Curtis et al. |
| 3,835,294 | A | 9/1974 | Krohn et al. |
| 3,844,338 | A | 10/1974 | Hilgemann et al. |
| 3,890,143 | A | 6/1975 | Skoglund et al. |
| 4,085,308 | A | 4/1978 | Youngquist |
| 4,094,167 | A | 6/1978 | Madsen |
| 4,141,222 | A | 2/1979 | Ritchie |
| 4,168,745 | A | 9/1979 | Lastinger |
| 4,182,928 | A | 1/1980 | Murphy et al. |
| 4,185,187 | A | 1/1980 | Rogers |
| 4,232,529 | A | 11/1980 | Babbitt et al. |
| 4,279,128 | A | 7/1981 | Leniger |
| 4,281,519 | A | 8/1981 | Spath et al. |
| 4,293,323 | A | 10/1981 | Cohen |
| 4,308,636 | A | 1/1982 | Davis |
| 4,353,220 | A | 10/1982 | Curwen et al. |
| 4,381,031 | A | 4/1983 | Whitaker et al. |
| 4,409,796 | A | 10/1983 | Fisher |
| 4,529,033 | A | 7/1985 | Blum |
| 4,594,500 | A | 6/1986 | Wright |

(Continued)

FOREIGN PATENT DOCUMENTS

| | | |
|---|---|---|
| CA | 1 2 21 838 | 5/1987 |

(Continued)

*Primary Examiner* — Tuan Nguyen

(74) *Attorney, Agent, or Firm* — Knobbe, Martens, Olson & Bear, LLP

(57) ABSTRACT

A spa or hot tub system includes a tub forming a cavity that holds a fluid such as water therein, and a water circulation system provides for circulation of water within the tub. The hot tub includes inner and outer surfaces, and defines an internal space. A heat pump system is operably connected to the water circulation system, and heats the water in the hot tub. The water side heat exchangers of the heat pump may include a polymer housing, and coiled inner elements for refrigerant. The coils may be made of a corrosion-resistant metal tubing or the like. The system may include a conventional electric heating element in addition to the heat pump to provide additional heating capacity.

20 Claims, 6 Drawing Sheets

U.S. PATENT DOCUMENTS

| | | | |
|---|---|---|---|
| 4,621,613 | A | 11/1986 | Krumhansl |
| 4,646,537 | A | 3/1987 | Crawford |
| 4,667,479 | A | 5/1987 | Doctor |
| 4,679,545 | A | 7/1987 | Cavestany |
| 4,718,248 | A | 1/1988 | Fisher |
| 4,733,417 | A | 3/1988 | De Shon |
| 4,762,980 | A | 8/1988 | Insley |
| 4,852,366 | A | 8/1989 | Harris |
| 4,907,418 | A | 3/1990 | DeFazio |
| 4,924,069 | A | 5/1990 | Giordani |
| 4,955,207 | A | 9/1990 | Mink |
| 5,094,593 | A | 3/1992 | Laing |
| 5,172,754 | A | 12/1992 | Graber et al. |
| 5,184,472 | A | 2/1993 | Guilbault et al. |
| 5,220,638 | A | 6/1993 | Moore et al. |
| 5,265,438 | A | 11/1993 | Knowles et al. |
| 5,313,874 | A | 5/1994 | Lackstrom |
| 5,318,007 | A | 6/1994 | Afshar |
| 5,396,574 | A | 3/1995 | Base et al. |
| 5,438,712 | A | 8/1995 | Hubenthal |
| 5,443,112 | A | 8/1995 | Scheideman |
| 5,495,723 | A | 3/1996 | MacDonald |
| 5,509,274 | A | 4/1996 | Lackstrom |
| 5,536,478 | A | 7/1996 | Lipp et al. |
| 5,550,753 | A | 8/1996 | Tompkins et al. |
| 5,559,720 | A | 9/1996 | Tompkins et al. |
| 5,560,216 | A | 10/1996 | Holmes |
| 5,613,372 | A | 3/1997 | Beal et al. |
| D388,161 | S | 12/1997 | Thweatt |
| 5,697,435 | A | 12/1997 | Stickford, Jr. et al. |
| 5,724,478 | A | 3/1998 | Thweatt |
| D398,042 | S | 9/1998 | Thweatt |
| 5,802,864 | A | 9/1998 | Yarbrough et al. |
| 5,809,942 | A | 9/1998 | Kralovec et al. |
| 5,875,283 | A | 2/1999 | Yane et al. |
| 5,906,104 | A | 5/1999 | Schwartz et al. |
| 5,930,852 | A | 8/1999 | Gravatt et al. |
| D415,264 | S | 10/1999 | Thweatt |
| 5,963,580 | A | 10/1999 | Eckert |
| 5,978,550 | A | 11/1999 | Rochelle |
| 6,080,973 | A | 6/2000 | Thweatt, Jr. |
| 6,131,237 | A | 10/2000 | Kasper et al. |
| 6,175,970 | B1 | 1/2001 | Pinciaro |
| 6,192,549 | B1 | 2/2001 | Kasen et al. |
| 6,367,279 | B1 | 4/2002 | Jin |
| 6,460,202 | B1 | 10/2002 | Nameche |
| 6,499,534 | B1 | 12/2002 | Tawney et al. |
| 6,555,796 | B1 | 4/2003 | Cusack |
| 6,601,773 | B2 | 8/2003 | Saitoh et al. |
| 6,621,985 | B1 | 9/2003 | Thweatt, Jr. |
| 6,643,454 | B1 | 11/2003 | Rochelle |
| 6,651,454 | B1 | 11/2003 | Spiegel |
| 6,694,541 | B2 | 2/2004 | Nameche |
| 6,789,615 | B2 | 9/2004 | Michelfelder et al. |
| 6,873,793 | B2 | 3/2005 | Thweatt |
| 6,899,357 | B2 | 5/2005 | Rochelle |
| 6,941,064 | B2 | 9/2005 | Thweatt, Jr. |
| 6,981,650 | B2 | 1/2006 | Uy et al. |
| 7,065,292 | B2 | 6/2006 | Thweatt, Jr. |
| 7,065,293 | B2 | 6/2006 | Thweatt, Jr. |
| 7,076,874 | B2 | 7/2006 | Rochelle |
| 7,104,079 | B2 | 9/2006 | Kuwabara et al. |
| 7,104,314 | B2 | 9/2006 | Valensa et al. |
| 7,155,922 | B2 | 1/2007 | Harmon et al. |
| 2007/0079436 | A1* | 4/2007 | Na et al. ..... 4/541.1 |
| 2007/0180606 | A1 | 8/2007 | Pickrell et al. |
| 2007/0180607 | A1 | 8/2007 | Pickrell et al. |
| 2007/0241098 | A1 | 10/2007 | Graham et al. |

FOREIGN PATENT DOCUMENTS

| | | |
|---|---|---|
| EP | 0 097 216 Al | 1/1984 |
| JP | 2002013838 | 1/2002 |
| WO | WO 2007044640 A2 | 4/2007 |

* cited by examiner

SPA HAVING HEAT PUMP SYSTEM

CROSS-REFERENCE TO RELATED APPLICATIONS

This is a continuation of International Application PCT/US2008/059225, with an international filing date of Apr. 3, 2008. PCT Application No. PCT/US2008/059225 claims the benefit of U.S. Provisional Application No. 60/909,869, filed on Apr. 3, 2007, entitled SPA HAVING HEAT PUMP SYSTEM. The entire contents of the above-identified International Application and Provisional Application are incorporated herein by reference.

BACKGROUND OF THE INVENTION

Various types of heating units for heating water in spas/hot tubs have been developed. One type of known heater utilizes an electrical resistance element that generates heat when electrical current passes through the electrical resistance element. Heat generated by the electrical resistance element is transferred through electrically non-conductive material to the water from the spa/hot tub as it flows through the heater to thereby heat the water in the spa/hot tub. The chemicals and the like added to the water in a spa or hot tub may create a corrosive environment. The temperature extremes further contribute to creating a relatively harsh operating environment for heaters in such applications.

Also, known electrical heating units may not provide the desired degree of efficiency. Various types of heat pumps have been developed for use in heating swimming pools and the like. Although such heat pumps have been somewhat successful, they are generally too large and bulky for use in a compact spa/hot tub system. Furthermore, heat pumps developed for swimming pools are generally not designed to heat the water to higher temperatures as required for a typical spa/hot tub, and may also not be suitable for use in the uniquely harsh environment of a typical spa/hot tub. Still further, known electrical heaters for spas/hot tubs may have limited power, such that substantial time is required to bring the water in the spa/hot tub up to the desired temperature if the water was cooled after a period of non-use or the like.

SUMMARY OF THE INVENTION

One aspect of the present invention is a spa or hot tub system including a tub having an inner surface defining a tub cavity. The tub is configured to hold sufficient fluid to immerse at least a substantial portion of a user seated in the tub. The tub defines an upper peripheral edge extending around the cavity, and the inner surface of the tub is formed by an inner side wall having an upper portion adjacent the upper peripheral edge. The tub further defines a generally upright side wall forming an outer skirt having an enlarged outer tub surface facing outwardly. The tub defines an interior space between portions of the inner side wall and the outer side wall. The system further includes at least one fluid outlet for exit of fluid from the cavity, and a heat pump system including a water side heat exchanger and an air side heat exchanger. The heat pump system further includes a compressor, and refrigerant conduits fluidly interconnecting the water side heat exchanger and the air side heat exchanger to the compressor, and providing for flow of refrigerant through the water side heat exchanger and through the air side heat exchanger when compressed by the compressor. The water side heat exchanger, the air side heat exchanger, and the compressor may be positioned within the interior space of the tub. The system also includes a water pump and a plurality of fluid conduits fluidly interconnecting the pump to the water side heat exchanger and the fluid inlets and fluid outlet, such that the water pump circulates water from the tub cavity through the water side heat exchanger, such that the water is heated prior to flowing into the tub cavity through the fluid inlets. The system further includes a temperature sensor configured to sense a temperature of water in the tub. A controller is operably connected to the temperature sensor and to the heat pump system, and the controller is configured to control the heat pump system based, at least in part, on the temperature of the water in the tub.

DETAILED DESCRIPTION OF PREFERRED EMBODIMENT

Figure 1:
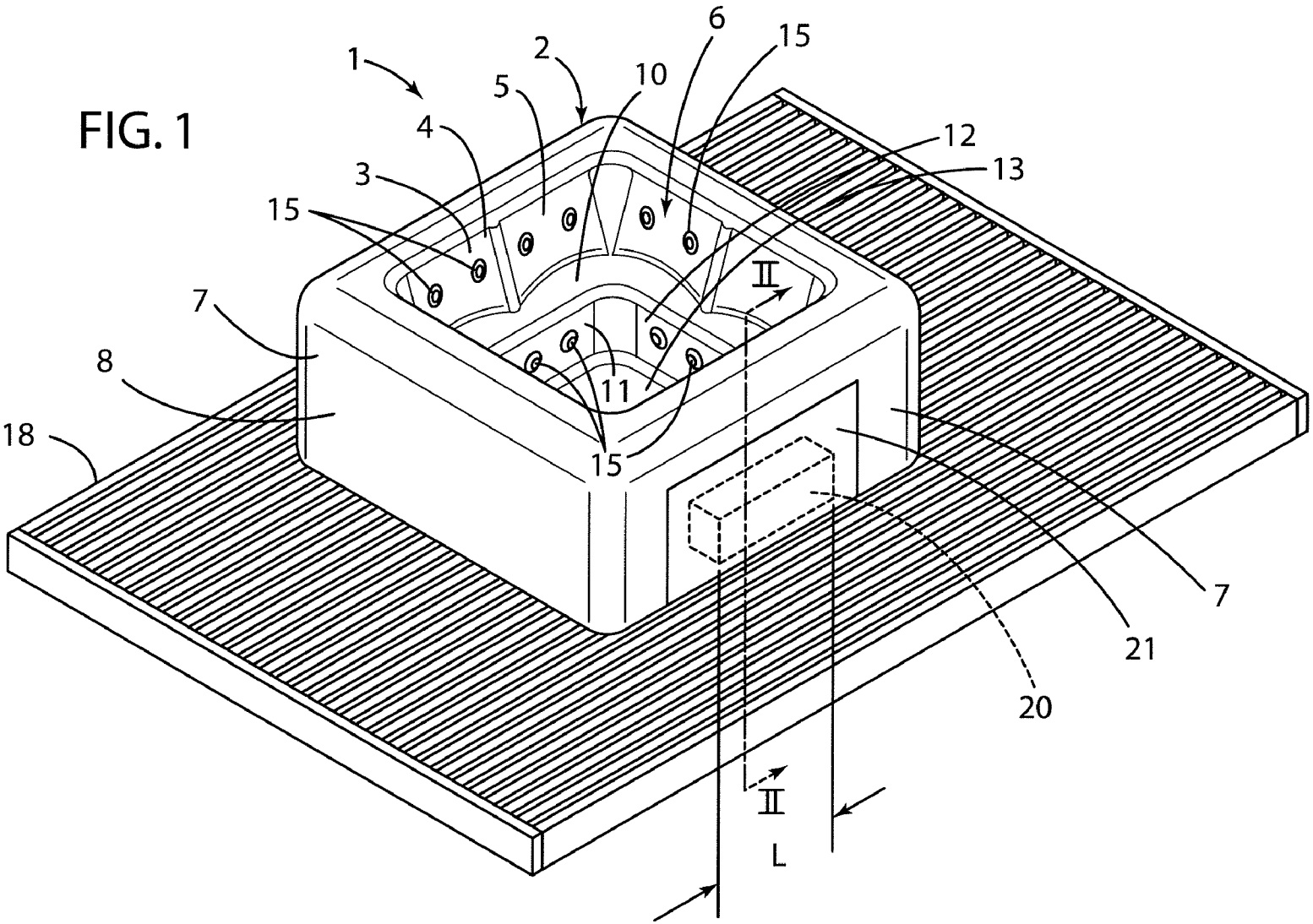
FIG. 1 is an isometric view of a spa/hot tub according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a spa/hot tub system 1 according to the present invention includes a primary structure 2 that may be made of a fiber-reinforced polymer or other polymer material or the like. The primary structure 2 forms a tub 3 having a side wall 4 forming a plurality of seats 5 that are configured to seat users in an upright position in a cavity 6 defined by tub 3. Seats 5 are formed by an upwardly-facing wall portion 10 and a lower vertical wall portion 11. A foot well portion 12 of tub 3 is formed by vertical wall portions 11 and a generally horizontal lower wall 13. The tub 3 typically has sufficient size to immerse at least a substantial portion of at least one user seated in a seat 5. The primary structure 2 includes an outer side wall or skirt 7 that is spaced apart from the side wall 4 to define an internal space or cavity 8 between the relatively thin material forming the skirts 7 and side wall 4. A plurality of nozzles/water jets 15 or the like may be positioned in the side wall 4 to direct jets of water into cavity 6 in a known manner.

Figure 2:
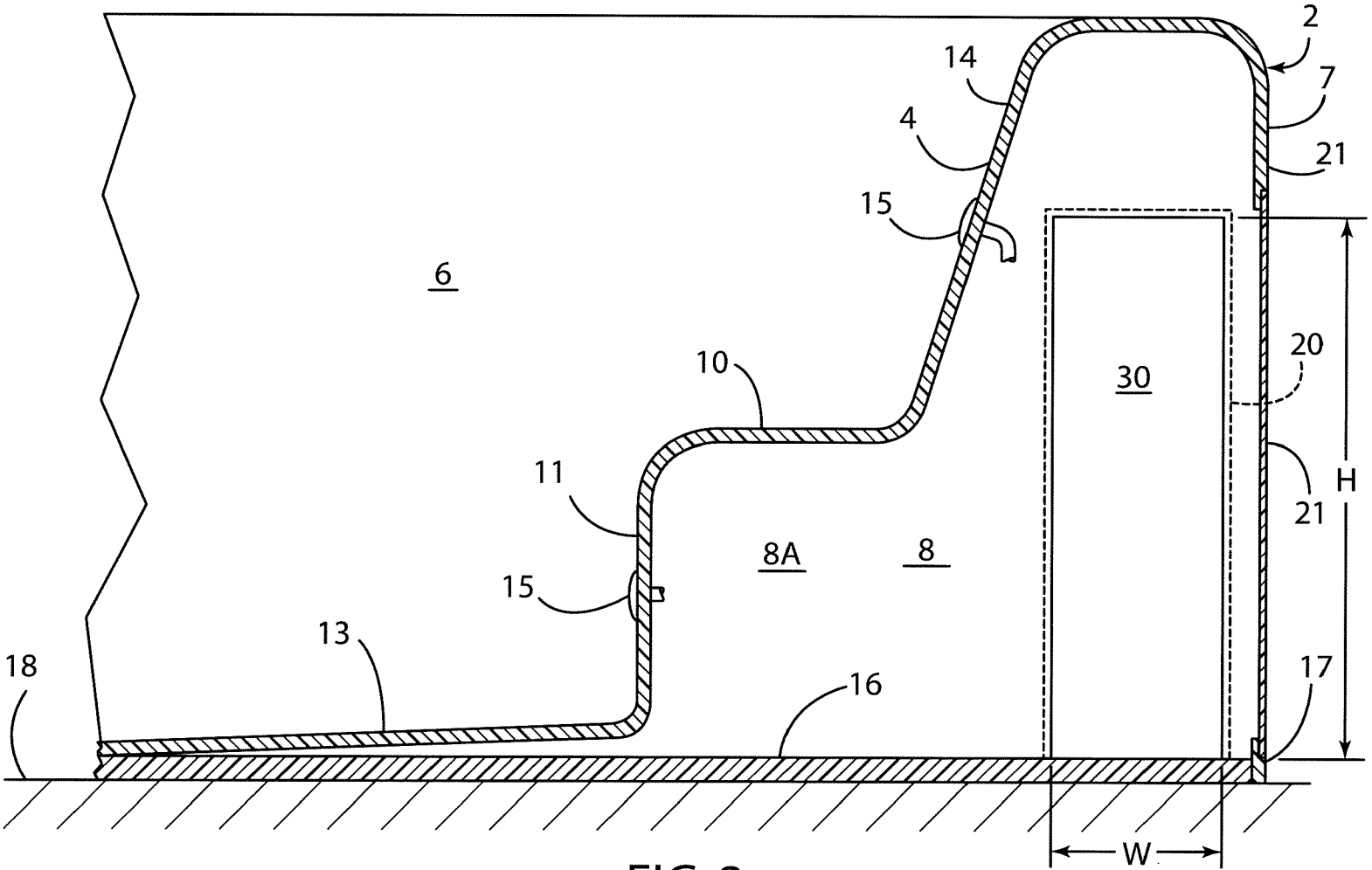
FIG. 2 is a cross-sectional view of the spa/hot tub of FIG. 1 taken along the line II-II.

As shown in FIG. 2, primary structure 2 includes a generally horizontal base member 16 that extends between a lower edge portion 17 of skirt 7, across the lower side wall 13. Base member 16 is configured to support the primary structure 2 on a support surface 18 and also support lower wall 13 of tub 3. One or more removable access panels 21 are connected to the primary structure 2 utilizing conventional threaded fasteners (not shown) or other suitable connectors.

An envelope or three-dimensional space 20 within cavity 8 receives a heat pump system 30 according to the present invention. The removable access panel 21 can be removed to provide access to the heat pump system 30 mounted in cavity 8. Although the size of the three-dimensional space or envelope 20 may be different for different spa/hot tub systems 1, in general, the size of cavity 8 is limited by the shape/size of the side walls of tub 3. Thus, the size of envelope 20 is also at least somewhat limited. The heat pump system 30 of the present invention is quite small/compact such that it fits within the three-dimensional space 20. In the illustrated example, the three-dimensional space or envelope 20 has a width "W" (FIG. 2) of about 12-16 inches, a height "H" of about 20-22 inches, and a length "L" (FIG. 1) of about 16-20 inches. In the illustrated example, the length "L" is about 18 inches. The volume of the three-dimensional space 20 is generally in the range of about 2.5 cu. ft. to about 3.75 cu. ft. Nevertheless, it is anticipated that the envelope 20 could be as small as 2.0 cu. ft., or even as small as 1.5 cu. ft., or as large as 4.0, 5.0 or 6.0 cu. ft., depending upon the design/configuration of the primary structure 2, and the heating and/or cooling capacity required of the heat pump. In the illustrated example, the envelope or three-dimensional space 20 has a six-sided box-like shape (i.e. a rectangular prism) with an upper portion thereof disposed between seat back 14 and skirt 7. However, the three-dimensional space 20 may also have an irregular shape, and it may occupy a portion 8A of cavity 8 below surface 10 of seat 5.

Figure 3:
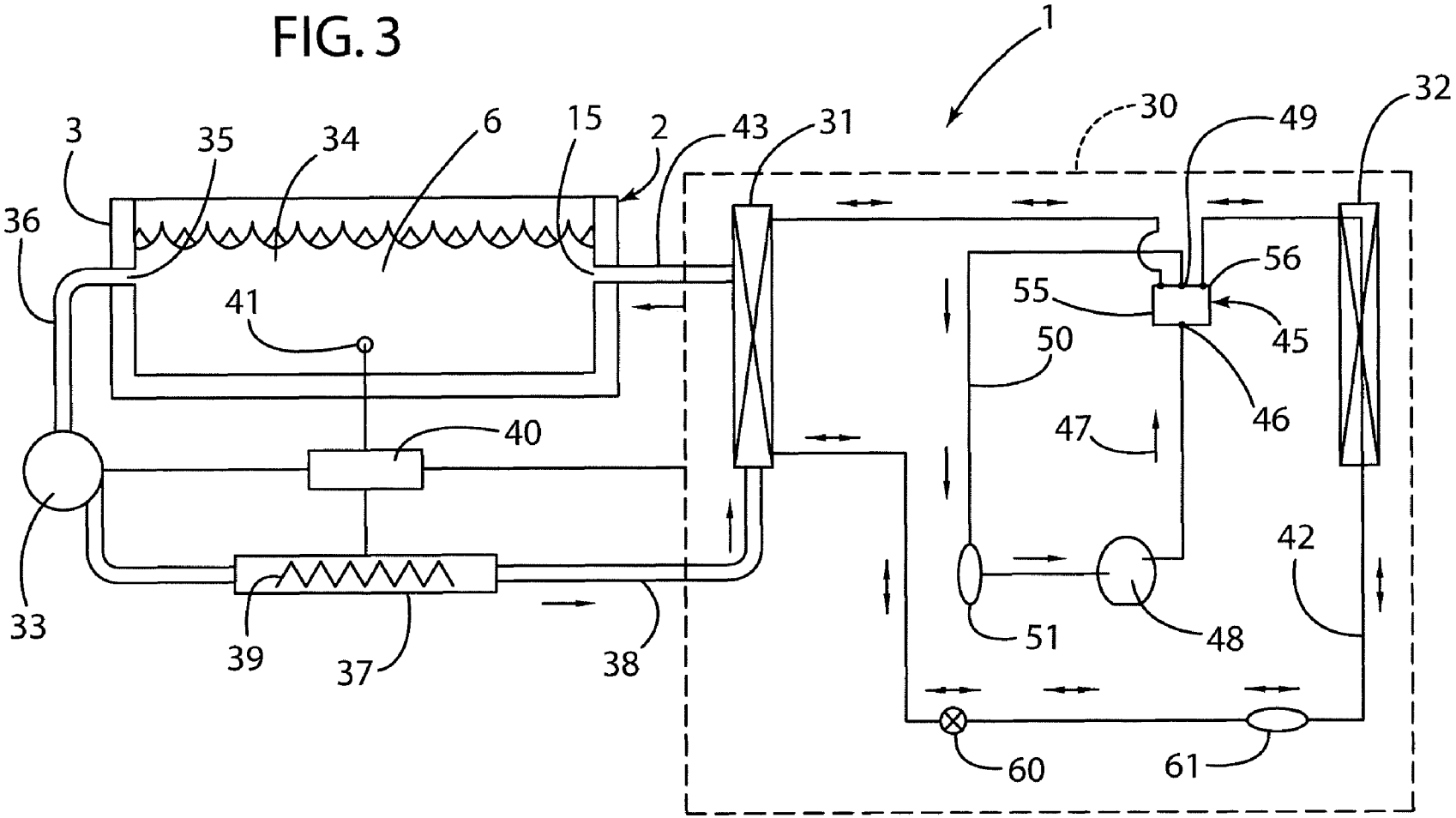
FIG. 3 is a schematic view of the spa/hot tub of FIG. 1 showing the heat pump, heat exchangers, and related components.

With further reference to FIG. 3, a spa/hot tub system 1 according to the present invention includes a heat pump system 30 having a water side heat exchanger 31, and an air side heat exchanger 32. As discussed in more detail below, heat pump system 30 can be utilized to heat or cool the water in tub 3. A conventional water pump 33 pumps water 34 received in outlet 35 via pipe 36 through a conventional electrical heater 37. After the water flows through the electrical heater 37, it enters pipe 38, and then passes through water side heat exchanger 31, and then exits into cavity 6 via 1 or more water jets 15. Electric heater 37 includes a resistive electric heating element 39 that is operably connected to a source of electrical power. The electric heater 37 can be used at the same time the heat pump system 30 is in operation to increase the rate at which the water 34 is heated. In this way, if the spa/hot tub 1 is used intermittently, such as at a cabin or the like that is typically only used on weekends, the heat pump 30 and electric heater 37 can be turned off when the spa/hot tub 1 is not in use. However, when the electric heater 37 and heat pump system 30 are both used at the same time to heat the water 34, the temperature of the water 34 in the cavity 6 can be brought up to the desired temperature quite quickly.

A controller 40 is operably connected to a temperature sensor 41 that is positioned such that it senses the temperature of the water 34 in the cavity 6. The controller 40 is operably connected to the electric heater 37 and the heat pump 30, and may also be connected to the pump 33. Although controller 40 may be configured to operate in different ways, it will typically operate as a thermostat to maintain the water in the tub 3 at a user-selected temperature. In the illustrated example, the tub 3 has a capacity of about 400-500 gallons of water, and the heat pump system 30 is preferably capable of maintaining the water in the tub at a temperature of 105° F., even if the spa/hot tub system 1 is placed in ambient temperatures of about 60° F. to about 140° F., and more preferably about 45° F. to about 140° F.

The heat pump system 30 includes fluid conduits 42 interconnecting the water side heat exchanger 31, air side heat exchanger 32, and other system components. The heat pump system 30 includes a four-way valve 45 having an inlet port 46 that receives hot compressed refrigerant 47 from a compressor 48. Refrigerant exiting outlet port 49 of four-way valve 45 flows through fluid conduit 50, and through an accumulator 51. The accumulator 51 is a conventional unit that collects any fluid in the refrigerant exiting outlet port 49 and thereby ensures that the fluid does not enter compressor 48.

Four-way valve 45 can be switched to a first position to provide for heating water in tub 3, or it can be switched to a second position to cool water in tub 3. Valve 45 includes a first two-way port 55, and a second two-way port 56. When four-way valve 45 is switched to a first position (heating), refrigerant 47 passes from inlet port 46 and exits first two-way port 55. In this configuration (heating), the refrigerant first flows through water side heat exchanger 31, and then flows through a bi-directional restrictor 60, through a bi-flow filter 61, through air side heat exchanger 32, and into second two-way port 56, and back out through outlet port 49. The bi-directional restrictor may be substantially similar to the restrictor of U.S. Pat. No. 5,265,438, issued on Nov. 30, 1993, the entire contents of which are incorporated by reference.

Alternately, when four-way valve 45 is configured to provide cooling, refrigerant 47 entering inlet port 46 is directed out the second two-way port 46, and the refrigerant 47 first passes through air side heat exchanger 32. In the cooling configuration, the gas 47 exits air side heat exchanger 32, flows through bi-directional filter 61, then through bi-directional restrictor 60, and then through water side heat exchanger 32, and then back into first two-way port 55, and out the outlet port 49 of four-way valve 45.

Thus, when the four-way valve 45 is in the heating configuration/mode, the heat pump system 30 heats the water 34 in the cavity 6. However, when the four-way valve 45 is in cooling configuration/mode, the heat pump system 30 cools the water 34 in cavity 6 of the primary structure 2. It will be understood that in very hot climates it may be desirable to cool the water 34 to provide a comfortable environment for users of the spa system 1.

Figure 4:
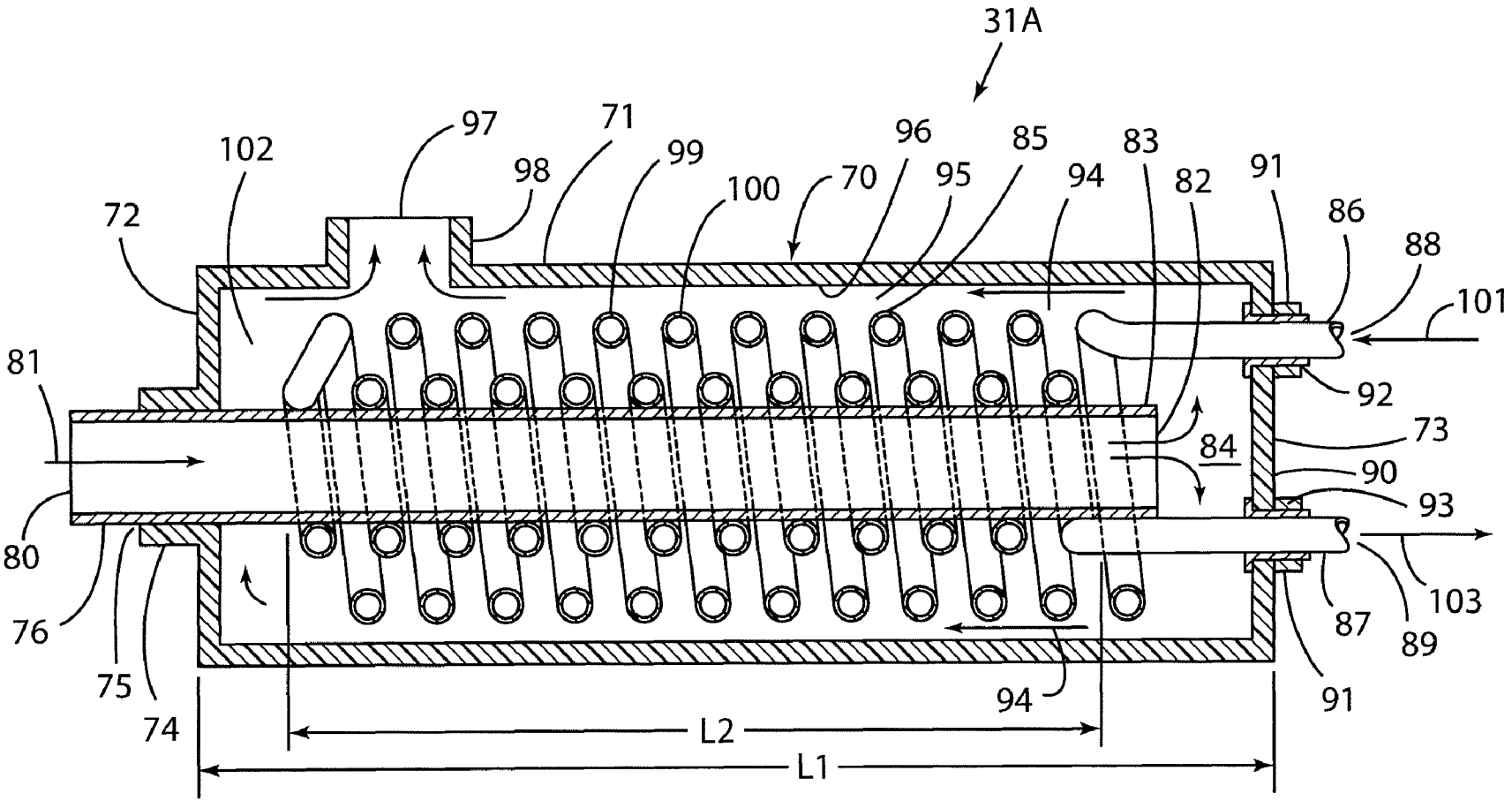
FIG. 4 is a cross-sectional view of a heat exchanger according to one aspect of the present invention.

With further reference to FIG. 4, the water side heat exchanger 31 may comprise a first water side heat exchanger 31A having a housing 70 made of a suitable non-corrosive material such as a PVC polymer. Housing 70 includes a cylindrical body portion 71 that is closed off by opposite ends 72 and 73. An outwardly extending annular flange or sleeve 74 at end 72 forms an aperture 75 that receives a smaller internal tube 76 that may be made of a PVC polymer or other suitable material. The connection between the flange or sleeve 74 and tube 76 is watertight, and a suitable adhesive/sealant may be used to secure and seal the tube 76 in the aperture 75 formed by flange or sleeve 74. Although the dimensions, shapes, and the like of the various components of the heat exchanger 31A may vary substantially, in the illustrated example the housing 70 and internal tube 76 comprise ASTM schedule 40 tubing. The internal tube 76 has an outer diameter of about 1½ inches, and the cylindrical body 71 has an outer diameter of about 4½ inches. Alternately, the housing 70 and internal tube 76 may comprise a one-piece molded unit. It will be understood that the housing 70 and internal tube 76 could have non-cylindrical configurations. Also, in the illustrated example, the length L1 of cylindrical body 71 is about 19½ inches, and the length L2 of coiled tube 85 is about 17-18 inches.

In use, water 81 flows into opening 80 of internal tube 76, and exits at opening 82 at end 83 of tube 76 into internal cavity 84 formed by housing 70. A coiled tube 85 is coiled around internal tube 76 in a double helix, and includes a first end 86 extending through end wall 90 at end 73 of housing 70 to form an inlet 88. Coiled tube 85 further includes a second end 87 that also extends through end wall 90 of housing 70, thereby forming an outlet 89. Fittings 91 provide a fluid-tight seal between the ends 86 and 87 of coiled tube 85 and openings 92 and 93 in end wall 90 of housing 70.

As discussed above, water 81 flows through tube 76 when it enters heat exchanger 31*a*, and exits opening 82 of tube 76 into cavity 84 of housing 70. The water then flows in the direction of the arrows 94 through the space 95 between coiled tube 85 and inner cylindrical surface 96 of cylindrical body 71 of housing 70. The water then flows out of an opening 97 formed by a flange 98. Referring back to FIG. 3, the water flowing out of opening 97 flows through one or more conduits 43, and exits into cavity 6 of primary structure 2 through water jets 15.

In the illustrated example, the tubing used to form the coiled tube 85 (FIG. 4) is a fully annealed 304L stainless steel tubing having a nominal OD of ⅜ inch. Although the wall thickness and size/material could vary, in the illustrated example, the tubing has a wall thickness of 0.035 inches. The coiled tube 85 is preferably deformed such that the outer coils 99 are spaced part by a distance that is approximately equal to the diameter of the tubing of coiled tube 85. Inner coils 100 are also preferably spaced apart from each other a distance about equal to the diameter of the tubing forming coils 100. The outer coils 99 are also spaced apart from adjacent inner coils 100 a distance that is about equal to the diameter of the tubing forming coils 99 and 100. This provides a compact configuration for the coiled tube 85 and also provides for water flow around the tube 85 to thereby transfer heat from the water to the refrigerant and vice versa. It will be understood that the coiled tube 85 could have configurations other than the illustrated double helix.

In use, refrigerant 101 flows into inlet 88 formed by first end 86 of coiled tube 85. The refrigerant 101 travels through the helix formed by the outer coils 99 until it reaches end 102 of coiled tube 85. Refrigerant 101 then travels back through the inner helix formed by inner coils 100 directly adjacent internal tube 76. Refrigerant 103 then exits the first water side heat exchanger 31*a* at outlet 89.

When the heat pump system 30 is in the heating mode, refrigerant 101 entering the heat exchanger 31A is quite hot relative to the water 81 entering heat exchanger 31A at opening 80, such that heat exchanger 31A heats the water before it is returned to the tub 3 through conduit 43 and water jets 15. As discussed above, when heat pump system 30 is being utilized to heat water 34 in tub 3, electric heater 37 may also be activated to thereby heat the water 34 in a very rapid manner. Alternately, if the heat pump system 30 is being utilized to cool the water 34 in tub 3, the refrigerant 101 entering heat exchanger 31A will be colder than the water 81 entering heat exchanger 31*a*, such that heat exchanger 31A acts to cool the water 34 in tub 3.

Figure 5:
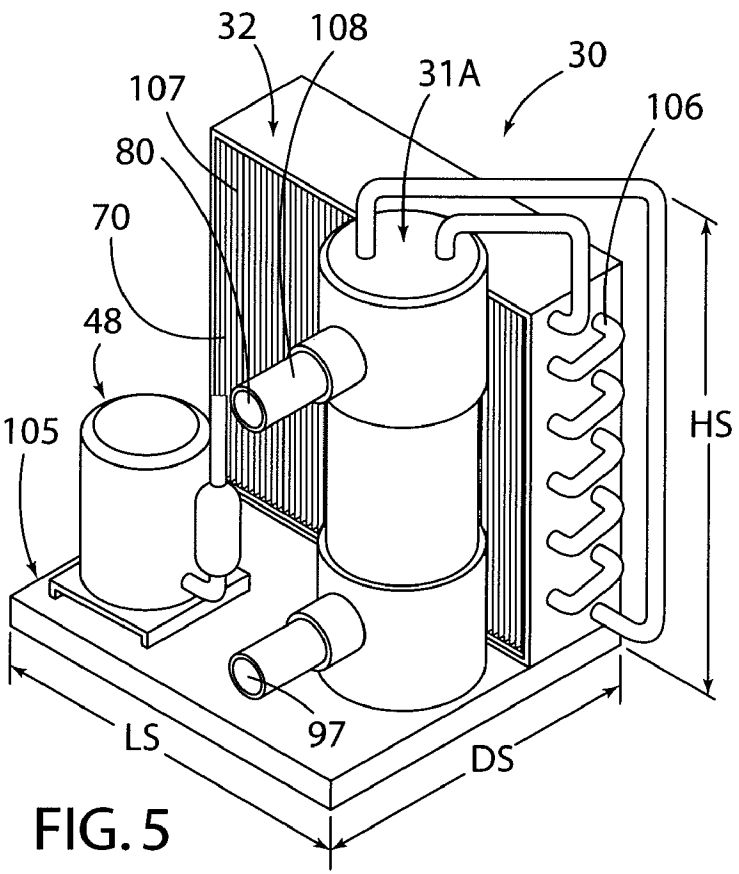
FIG. 5 is an isometric view of a heat pump system and related components including the heat exchanger of FIG. 4.

With further reference to FIG. 5, first water side heat exchanger 31A may be mounted to a support structure 105 that supports compressor 48, accumulator 51, air side heat exchanger 32, and related tubing and the like. Support structure 105 can be removed from main structure 2 as a unit to thereby facilitate repair/servicing of heat pump system 30. The air side heat exchanger 32 is a conventional unit having a plurality of tubes 106 and fins 107 to promote heat transfer. The heat exchanger 31A of FIG. 5 is substantially the same as shown in FIG. 4 except that inlet 80 is formed by a transverse tube 108 rather than a straight tube as shown in FIG. 4. An internal elbow (not shown) changes the direction of the flow of water entering internal tube 76 after it enters housing 70 through tube 108. The length "LS" of the single stage heat pump system 30 shown in FIG. 5 is about 18 inches, the depth "DS" is about 12 inches, and the height "HS" is about 20 inches. The support structure 105 provides a unitary structure for the heat pump 30, such that it can be removed as a unit from the primary structure 2 of the spa/hot tub system 1 if needed for repair.

Figure 6:
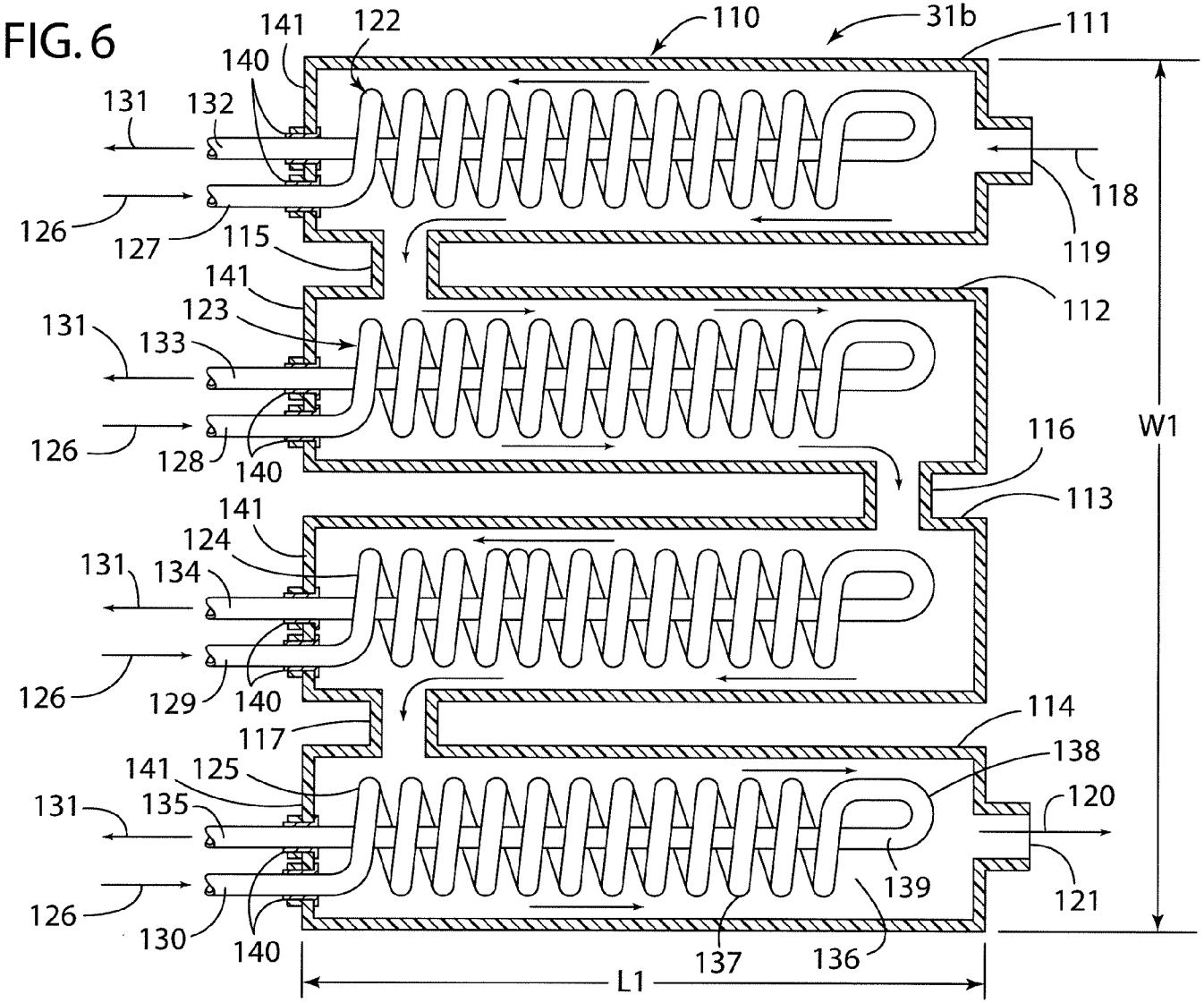
FIG. 6 is a cross-sectional view of a heat exchanger according to another aspect of the present invention.

With further reference to FIG. 6, a "multi-pass" water side heat exchanger 31B according to another aspect of the present invention includes a housing 110 having cylindrical tubular portions 111, 112, 113 and 114. Tubular portion 111 is fluidly connected to tubular portion 112 by a passageway 115, tubular portion 112 is fluidly connected to tubular portion 113 by a passageway 116, and tubular portion 113 is fluidly connected to tubular portion 114 by passageway 117. Water 118 enters housing 110 at inlet 119, flows through cylindrical tubular portion 111, through passageway 115, through cylindrical tubular portion 112, then through passageway 116, through cylindrical tubular portion 113, through passageway 117, through tubular portion 114, and exits housing 110 at outlet 121 as designated by arrow 120. As the water flows through the housing 110, it comes into contact with coiled tubes 122, 123, 124 and 125. Refrigerant 126 enters each of the coiled tube sections 122-125 at inlets 127-130, respectively, and refrigerant 131 exits at outlets 132-135, respectively. The coiled tube portions 122-125 are substantially identical to one another, and include an outer helix 136 formed by a plurality of coils 137 that are preferably spaced apart a distance about equal to the diameter of the tubing used to form coils 137. An end loop portion 138 extends from an end of helix 136 joins with a straight center tube portion 139 that extends through helix 136 to form outlet 132. A plurality of fittings 140 provide a fluid-tight seal at the locations where the inlets 127-130 and outlets 132-135 pass through end walls 141-144 of cylindrical tubular portions 111-114, respectively. In the illustrated example, the cylindrical tubular portions 111-114 comprise ASTM schedule 40 PVC tubing with an outer diameter of about 2⅜ inch, and a length L1 of about 13 inches. The housing 110 has a width "W1" of about 11 inches. The housing 110 could also comprise a one-piece polymer molded unit forming a plurality of interconnected cavities within which coiled tubes 122-125 are disposed. It will be understood that the cavities within which tubes 122-125 are disposed could be non-cylindrical in shape, and the coiled tubes 122-125 could have configurations other than the illustrated helixes. The tubing utilized to form coiled tubular portions 122-125 is preferably a fully annealed 304L stainless steel tubing having an OD of ¼ inch, and a wall thickness of 0.035 inches. The stainless steel tubing is coiled onto a mandrel (not shown) after bending the tubing to form end portion 138. The mandrel includes a bore through the center of the mandrel to accommodate the straight portion 139 of the tubing during the forming of the coils 137 forming the outer helix 136.

Figure 7:
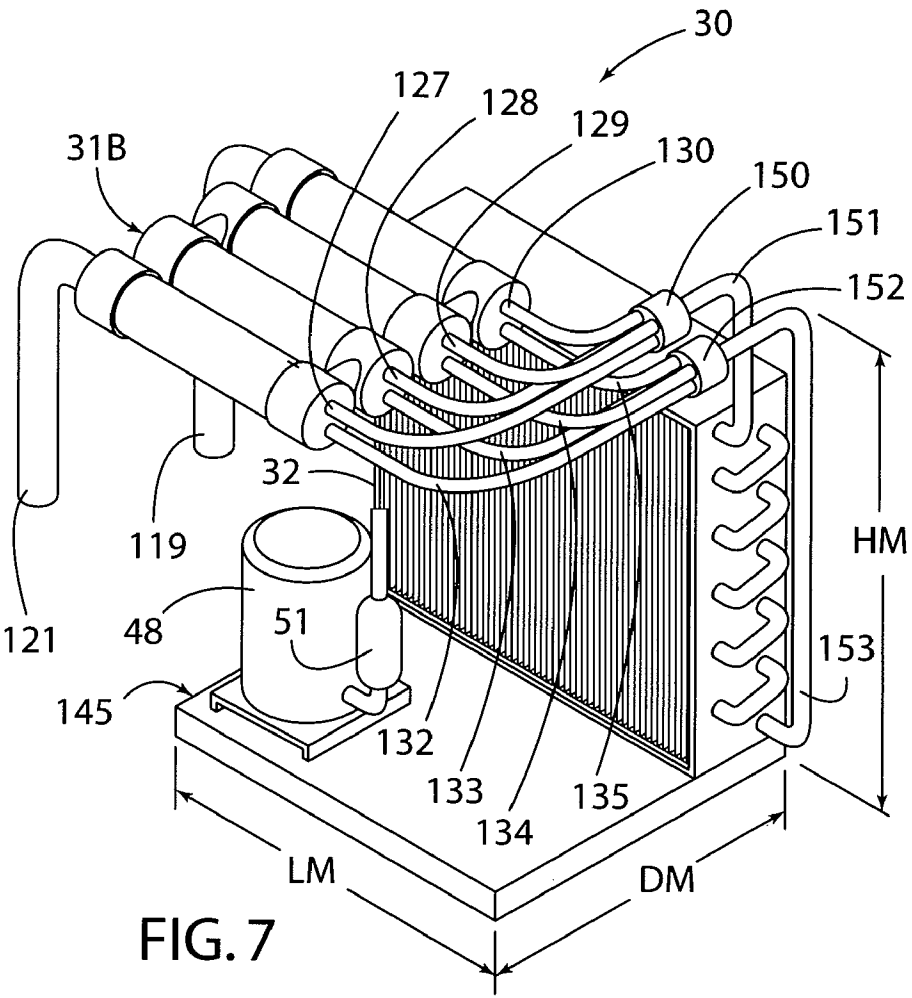
FIG. 7 is an isometric view of a heat pump system and related components including the heat exchanger of FIG. 6.

With further reference to FIG. 7, water side heat exchanger 31B may be mounted to a support structure 145 that is substantially similar to the support structure 105 described above in connection with FIG. 5. Each of the inlets 127-130 of coiled tubular portions 122-125 connect to a collector 150, which in turn is fluidly connected to a single tube or fluid passageway 151 to fluidly connect the coiled tubular portions 122-125 to the air side heat exchanger 32. Similarly, the outlets 132 of coiled tubular portions 122-125 are connected to a collector 152 which, in turn, is connected to a tube 153 to thereby connect the outlets 132-135 to the air side heat exchanger 32. The heat pump system 30 utilizing water side heat exchanger 31B has a length "LM" of about 18 inches, a depth "DM" of about 12 inches, and a height "HM" of about 20 inches.

The polymer housings of the water side heat exchangers 31A and 31B, and the stainless steel coils for the refrigerant are both very corrosion resistant, such that the water side heat exchangers 31A and 31B are very durable despite the harsh environment resulting from chemicals and the like typically utilized in water circulated in spas and hot tubs. Although the tubing for the coolant has been described as being made of stainless steel, it will be understood that titanium tubing or other tubing made of highly corrosion-resistant material may also be utilized for the coolant tubing disposed within the housing of heat exchangers 31A and 31B. Also, although polymer material is preferred for the housings of heat exchangers 31A and 31B, other suitable materials may also be utilized.

The water side heat exchangers 31A and 31B are not only very durable and corrosion-resistant, but they are also compact relative to the amount of heating and/or cooling they provide. A typical spa/hot tub has a water capacity of about 400-500 gallons. A heat pump having a capacity of about 1 ton is typically specified for such applications to provide sufficient heating (or cooling) for a spa/hot tub of this size. It will be appreciated that the dimensions given above for the water side heat exchangers 31A and 31B, and for the heat pump system 30 are relatively small for a heat pump of this capacity.

The compact configuration and small size of the heat pump system 30 and water side heat exchangers 31A and 31B permit the heat pump to be integrated into a spa/hot tub 1, without requiring that components be positioned outside the primary structure 2 of the spa/hot tub system 1. Furthermore, the heat pump system 30 provides sufficient capacity to maintain the water in the spa/hot tub system 1 at a temperature of 105° F. through a range of ambient temperatures from 45°-140° F. In this way, the heat pump system 1 can accommodate a wide range of ambient conditions yet still provide for efficient heating and/or cooling of the water in the spa/hot tub system 1. It will be understood that more or less capacity may be required for some applications.

The heat pump system 1 of the present invention may preferably provide up to about 5.5 kilowatts of heat to the water being heated utilizing only 1 kilowatt of input power. This amount of heat is about the same as a typical spa or hot tub heater having a 5.5 kilowatts capacity. If the conventional electric heater 37 (FIG. 3) and the heat pump 30 are both activated at the same time, the total heat generated may be in the range of 11 kilowatts, thereby heating the water in the spa/hot tub very quickly. If a spa/hot tub is utilized infrequently, such as at a cabin or the like that is frequented by the user on weekends, the spa/hot tub system 1 can be turned off during the week to thereby conserve energy. A remote control (not shown) may be operably connected to the controller 40. In this way, the user can remotely activate the heat pump system 30 and conventional electric heater 37 prior to traveling to the cabin or other location where the spa/hot tub system 1 is located. In this way, the spa/hot tub system 1 can be turned off when it is not being used, but brought quickly up to temperature when needed. In contrast, the relatively low heating power provided by prior systems generally require that the system be left on continuously, because the time required to bring the water up to the desired temperature is too long to permit the system to be turned on and off. If more or less heating capacity is required for a particular application, heat pump 1 may be configured to provide more or less heating capacity. For example, heat pump system 1 may be configured to provide as little as 2, 3 or 4 kilowatts, or it may be configured to provide as much as 6 or 7 kilowatts of heat.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A spa system, comprising:

a tub having an inner side wall defining an inner surface forming a tub cavity, wherein the tub is configured to hold sufficient fluid to immerse at least a substantial portion of a user seated in the tub, and wherein the tub defines an upper peripheral edge extending around the cavity, and wherein inner side wall has an upper portion adjacent the upper peripheral edge, the tub further including a generally upright side wall forming an outer skirt having an enlarged outer tub surface facing outwardly, the tub defining an interior space between portions of the inner side wall and the outer side wall;

at least one fluid outlet for exit of fluid from the cavity;

a heat pump system including a water side heat exchanger and an air side heat exchanger, a compressor, and refrigerant conduits fluidly interconnecting the water side heat exchanger and the air side heat exchanger to the compressor and providing for flow of refrigerant through the water side heat exchanger and through the air side heat exchanger when compressed by the compressor; and wherein:

the water side heat exchanger, the air side heat exchanger, and the compressor are positioned within the interior space of the tub;

a water pump and a plurality of fluid conduits fluidly interconnecting the pump to the water side heat exchanger and fluid inlets and the fluid outlet, such that the water pump circulates water from the tub cavity through the water side heat exchanger, whereby the water is heated prior to flowing into the tub cavity through the fluid inlets;

a temperature sensor configured to sense a temperature of water in the tub;

a controller operably connected to the temperature sensor and to the heat pump system, wherein the controller is configured to control the heat pump system based, at least in part, on the temperature of the water in the tub; and the water side heat exchanger comprises a multi-pass unit having a housing comprising a first and a second tubular portion each defining a side wall and having inlets and outlets connected to the fluid conduits to provide for flow of fluid from the first tubular portion to the second tubular portion through the housing; and including:

a first coil connected to the refrigerant conduits, and wherein the first coil is made of a tubular metal material with inlet and outlet portions that extend through the side wall into the first tubular portion and wherein the inlet into a first tubular portion is located at a first end of the first tubular portion and the outlet is located adjacent a second end of the first tubular portion so that the fluid flows the length of the first coil;

a second coil connected to the refrigerant conduits, and wherein the second coil is made of a tubular metal material with inlet and outlet portions that extend through the side wall into the second tubular portion and wherein the inlet into a second tubular portion is located at a second end of the second tubular portion adjacent the second end of the first tubular portion and the outlet is located adjacent a first end of the second tubular portion so that the fluid flows the length of the second coil.

2. The spa system of claim 1, wherein:

the housing comprises a polymer material, and the first and second coils comprise stainless steel tubing.

3. The spa system of claim 1, wherein:

the housing includes first and second portions defining first and second interior spaces, respectively, and wherein the first coil is disposed within the first interior space, and the second coil is disposed in the second interior space, and wherein the first and second interior spaces are fluidly interconnected by a passageway such that fluid flows into the inlet of the housing, through the first interior space, through the passageway, through the second interior space, and then through the outlet.

4. The spa system of claim 3, wherein:

the first and second coils comprise helixes.

5. The spa system of claim 4, wherein:

the first and second coils include an elongated portion extending through the helixes.

6. The spa system of claim 5, wherein:

the helixes of the first and second coils define first and second center lines, respectively, and wherein the first and second center lines are generally parallel.

7. The spa system of claim 6, wherein:

the inlet portions of the first and second coils are fluidly connected to a collector; and wherein:

a line extending from the collector and fluidly connecting the collector to the air side heat exchanger.

8. The spa system of claim 7, wherein:

the collector comprises a first connector, and the line comprises a first line;

the outlet portions of the first and second coils are fluidly connected to a second collector; and wherein:

a second line extending from the second collector and fluidly connecting the second collector to the air side heat exchanger.

9. The spa system of claim 8, wherein:

the first and second collectors are disposed outside the housing.

10. The spa system of claim 1, wherein:

the first and second coils have substantially identical configurations.

11. The spa system of claim 3, wherein:

the first and second portions of the housing comprise first and second tubes having cylindrical interior surface portions.

12. The spa system of claim 11, wherein:

the first and second tubes define first and second center lines, and wherein the first and second center lines are substantially parallel to one another.

13. The spa system of claim 12, wherein:

the first and second tubes define opposite ends, and the housing includes end wall portions closing off the opposite ends, and wherein:

the inlet and outlet portions of the first coil extend through a first end wall portion; and wherein:

the inlet and outlet portions of the second coil extend through a second end wall portion.

14. The spa system of claim 3, wherein:

the housing includes third and fourth portions defining third and fourth interior spaces, respectively, and wherein:

a third coil disposed within the third interior space;

a fourth coil disposed within the fourth interior space, and wherein:

the third and fourth coils are made of a metal material and have inlet and outlet portions that extend through the housing side wall and fluidly connect to the refrigerant conduits.

15. The spa system of claim 4, wherein:

the first and second coils comprise metal tubes having an outer diameter of about 0.25 inches and a wall thickness of about 0.035 inches.

16. The spa system of claim 14, wherein:

the housing is about thirteen inches long, about eleven inches wide, and about two and three eighths inch thick.

17. The spa system of claim 1, wherein:

the heat pump system fits within a space having a volume in the range of about 2.5 cubic feet to about 3.75 cubic feet.

18. The spa system of claim 17, wherein:

the heat pump system has a capacity of about one ton.

19. The spa system of claim 1, wherein:

the air side heat exchanger, water side heat exchanger, and the compressor fit within a rectangular prism having a width of about 12-16 inches, a height of about 20-22 inches, and a length of about 18 inches.

20. The spa system of claim 1, wherein:

the air side heat exchanger, water side heat exchanger, and the compressor fit within a rectangular prism having a volume of about 2.5 cubic feet to about 3.75 cubic feet.

* * * * *